United States Patent [19]

Minoda et al.

[11] 4,149,322

[45] Apr. 17, 1979

[54] DRYING CONCENTRATION OF PHOTOGRAPHIC EMULSION COATING BY MICROWAVE IRRADIATION

[75] Inventors: Minoru Minoda; Masaharu Ogawa, Minami-ashigara, both of Japan

[73] Assignee: Fuji Photo Film Co., Ltd., Minami-ashigara, Japan

[21] Appl. No.: 828,118

[22] Filed: Aug. 26, 1977

[30] Foreign Application Priority Data

Aug. 27, 1976 [JP] Japan ..... 51-102265

[51] Int. Cl.[2] ..... F26B 3/28

[52] U.S. Cl. ..... 34/4; 34/18; 427/45

[58] Field of Search ..... 34/4, 18, 68; 427/45

[56] References Cited

U.S. PATENT DOCUMENTS

| | | | |
|---|---|---|---|
| 2,405,813 | 8/1946 | Blanchard | 34/4 X |
| 3,151,950 | 10/1964 | Newman et al. | 34/4 |
| 3,403,456 | 10/1968 | Smith, Jr. | 34/4 |
| 3,888,681 | 6/1975 | Horie et al. | 427/45 |

*Primary Examiner*—John J. Camby

*Attorney, Agent, or Firm*—Sughrue, Rothwell, Mion, Zinn and Macpeak

[57] ABSTRACT

A photographic emulsion coating on a travelling web 1 is irradiated by microwave energy propogated through a slotted, undulating waveguide 5 to condense or concentrate the coating by evaporating a significant percentage of its water content, thereby shortening the overall drying time for a given coating rate. A forced flow of air and/or other gases is established through apertures 9 in the waveguide under controlled temperature and humidity conditions, and the internal heating effected by the microwaves prevents the formation of a surface film which might impede subsequent drying.

3 Claims, 3 Drawing Figures

DRYING CONCENTRATION OF PHOTOGRAPHIC EMULSION COATING BY MICROWAVE IRRADIATION

BACKGROUND OF THE INVENTION

1. Field of the Invention

The present invention relates to a method and apparatus for making photographic light-sensitive material wherein a photographic emulsion is coated on a support web, such as photographic film, Baryta paper and the like, and thereafter irradiated with microwave energy before cooling and setting to thereby concentrate the coating and decrease the overall drying time.

1. Description of the Prior Art

In the past, photographic film has been made by coating a light-sensitive emulsion on a web, cooling and setting the coating, and thereafter using ordinary air to dry the coating under controlled humidity conditions, and it is a natural tendency to try to increase the coating speed in order to enhance production capacity. Since the coating and drying steps in manufacturing a film are conducted in a continuous manner, if the web transport speed is increased to increase the coating speed, the drying time becomes shortened if the drying zone is constant in length. Generally speaking, if the drying capacity is constant, the degree of drying progress is proportional to the drying time, resulting in difficulty in achieving sufficient drying. For this reason, it is necessary to lengthen the drying zone corresponding to the rate of increase in the coating speed to accomplish sufficient drying. This is difficult to realize, however, in terms of both space and the cost of the added installation. To achieve sufficient drying, additional means must thus be provided to relieve the drying load in order to meet the needs of hgh speed coating.

To relieve such drying load, two methods have been proposed to provide a concentrated photographic emulsion prior to its application to the web. One method is to concentrate the photographic emulsion during its formation process, and thereafter various chemicals are added and mixed with the emulsion. In the other method, the emulsion is firstly mixed with various chemicals, and thereafter the mixture is concentrated by a condenser, such as an evaporator, immediately before coating. In the former method, it is difficult to provide a uniform mixture when various chemicals are added after the emulsion has been produced, whereby the quality of the product might be increased. In the latter method, some problems occur, such as a pressure loss when the condensed emulsion is fed to a coating device, difficulty in removing generated bubbles, and difficulty in washing the coating device. Also, in both methods the condensed emulsion results in a decreased quantity of coating per unit area of the web, which results in the necessity of applying the coating in a thin layer, and it is difficult to provide a uniform coating due to the higher viscosity of the coating liquids.

SUMMARY OF THE INVENTION

It is therefore an object of the present invention to provide a method and apparatus for achieving high speed coating by decreasing the drying load without producing inferior product quality or coating problems. This object may be realized by coating a photographic emulsion on a web and thereafter concentrating the coating by means of microwave energy without cooling and setting the coating.

It has generally been known in the drying of photographic light-sensitive material that the best results are obtained, in terms of product quality, by slow wind drying over a long period of time at a low temperature, but this method is obviously not very efficient. As a result of further studies, it has been found that the quality of photographic light-sensitive material is most heavily influenced during the period from the later stage of a constant drying rate period to a falling (or decreasing) drying rate period, while the material quality is less influenced during the other drying periods. Thus, if the material is slowly dried by wind at a low temperature only from the later stage of the constant drying rate period to the falling drying rate period, the material quality will not be greatly affected even if the material is dried as quickly as possible in other periods.

The present invention utilizes such knowledge, whereby the photographic emulsion is coated on the web and thereafter irradiated by microwave energy to quickly dry and concentrate it during the early and middle periods in the constant drying rate period, after which the coating is cooled and set, and drying from the later stage of the constant drying rate period to the falling drying rate period takes place slowly at a low temperature without greatly affecting the quality of the dried material. Drying by means of microwave irradiation can be performed more efficiently and in less time than drying by means of wind, and therefore even if the drying starting at the later stage of the constant drying rate period is performed slowly at a low temperature by means of air blowing, the overall drying period can still be shortened. While the ratio of time required between the constant drying rate period and the falling drying rate period depends upon the kind, composition or the like of the photographic emulsion to be coated, it is normally 1 to 2, and accordingly, the drying time may be considerably shortened by the present invention.

When a solidified film is formed at the surface of the coating during the course of drying, it impedes the movement of water out of the coating and impairs the drying progress. With microwave irradiation, however, the interior of the coating is first heated so that the coating may be dried and concentrated without the formation of a film on the surface of the coating, and hence there is no hinderance to the subsequent normal drying by wind after the coating has been concentrated.

The irradiation of microwave energy onto the surface of the coating may be performed after coating without cooling and setting the coating. Spraying gases are preferably employed in addition to the microwave irradiation. When a boundary layer of high humidity is formed in the neighbourhood of the surface of the coating due to the water content vaporized from the interior and surface of the coating, it becomes a barrier to subsequent vaporization of the water content. The wind removes the boundary layer, and fresh air being fed into the concentrating device assists in maintaining constant humidity and drying conditions therein and in preventing the condensation of moisture.

The gases used for such purposes are not particularly limited as long as they are inactive relative to the coating and involve no handling dangers, and inactive gases such as nitrogen, carbon dioxide, helium or the like may be used in addition to air. From the economical viewpoint, air is most preferable in achieving the above-described purposes.

The temperature and humidity of the gas depends upon the kind, composition and the like of the photographic emulsion to be used, but the temperature is normally 5° to 35° C., and preferably 15° to 25° C., and the humidity is normally less than 50%RH, and preferably less than 30%RH.

As for the airflow, the greater the better within the limit of producing no unevenness in the coating surface. The actual value thereof varies with an extent of the fluidization of the coating by the microwave irradiation, that is, with the microwave intensity. Normally, a suitable airflow will be less than 10 $m^3/m^2$ min, preferably about 1 to 5 $m^3/m^2$ min.

The term microwave in the present invention refers to a.c. frequencies above several MHz but below ten thousand MHz. Because of industry Standards the most commercially available oscillators at present have usable frequencies of either 915 MHz or 2,450 MHz.

The concentration by microwave irradiation terminates at a point whereat the later stage of the constant drying rate period begins. It is difficult to express such point by the percentage of water because it varies with the kind and composition of emulsion, but it is generally the point where the percentage of water in the coating based on the average transfer weight is approximately 200%. That is, it is desirable that any water content above about 200% by removed by the microwave irradiation, with the percentage of water given by:

$$\frac{\text{Quantity of water contained in coating}}{\text{Quantity of solids in coating}} \times 100\ (\%)$$

In the present invention the water content in the coating is normally concentrated by the microwave irradiation immediately after coating, and thereafter, the coating is cooled and set. The cooling and setting are performed in a conventional manner. That is, they are normally performed by low temperature air at a dry bulb temperature of from −10 to 10° C.

After being cooled and set the coating is dried by blowing air at a dry bulb temperature of from 15° to 45° C. and relative humidity 10–50%RH against the coating with an airflow of 10 to 40 $m^3/m^2$ min.

The thus dried coating is then humidity controlled by air at a bulb dry temperature of from 20° to 40° C. and a relative humidity of from 50 to 70%RH.

The steps of cooling and setting the coating are not always required. For example, cooling and setting can be omitted where the coating fluidity has been decreased to an extent that the surface of the coating is not disordered by the application of air thereto.

Generally speaking, the greatest equipment cost for making photographic light-sensitive material involves the air conditioning installation. Since the cost of such installation is generally in proportion to the airflow used, it is thus very important to minimize the airflow requirements in order to reduce the final cost of the photographic light-sensitive material. Further, the amount of airflow largely occupies in the operational cost, so that the minimization of the amount of airflow greatly contributes to reduce the operational cost. The airflow required for the microwave irradiation is smaller than that required for a conventional drying process only by air, and the drying time as a whole is shortened, whereby it is possible to materially reduce the airflow and the costs of the installation and operation.

The photographic emulsion to be coated sometimes contains methanol, ethanol and other organic solvents in the amount of about 2 to 15 wt%, and it is known that these solvents are normally vaporized during the first half of the drying process. In the present invention, however, these solvents are almost completely vaporized during the microwave concentration stage. Since the quantity of air used in the concentration stage is generally small, the density of the vaporized organic solvents contained in waste gases from the concentrating device is thus quite high, and it is therefore possible to readily recover such organic solvents as a source of public hazard.

The photographic light-sensitive material produced effectively by the method of the present invention includes a layer of silver halide emulsion on a support, and the emulsion may include silver chloride, silver bromide, silver iodide, silver chloride bromide, silver iodide bromide, and silver chloride iodide bromide.

The protective colloid for the emulsion includes gelatin, which is most common, and water soluble high polymer compounds such as gelatin derivatives, such as phthalic gelatin, colloidal albumin, polyvinyl alcohol, etc., independently or jointly.

The weight ratio of the protective colloid to silver halide can be varied widely. Fog may effectively be prevented when the weight ratio of silver halide to protective colloid is in excess of 0.8.

The silver halide photographic emulsion may be chemically sensitized by a method well-known in the air with a compound containing a labile sulfur atom such as sodium thiosulfate, alkylthiocarbazide, etc., a compound such as the gold (I) thiocyanate complex salt, a reducing agent such as stannous chloride, polyalkyleneoxide derivative or a combination of these. Further, the silver halide photographic emulsion may be optically sensitized only by the cyanine dye such as 1,1'-diethylcyanine iodide, 1,1'-diethyl-9-methylcarbocyanine bromide, anhydro-5,5'-diphenyl-9-ethyl-3,3'-di(2-sulfoethyl)-benzoxazolocarbocyanine hydroxide and the like and a combination of these. In addition, the emulsion may include chemicals which can release development restraining substances, such as 2-iodo-5-pentadecylhydroquinone, 2-methyl-5-(1-phenyl-5-tetrazolylthio)-hydroquinone, or the like, stabilizers such as 4-hydroxy-6-methyl-1,3,3*a*,7-tetrazaindene, benzimidazole, 1-phenyl-5-mercaptotetrazole, hardeners such as formaldehyde, mucobromic acid, and coating assistants such as saponin, sodium alkylbenzenesulfonates.

The emulsion maybe coated in layers on supports such as polyester, polycarbonate, polystyrene, cellulose acetate, polypropylene and the like.

The protective colloid layer including gelatin may be placed on the emulsion layer. In this case, the content of the protective colloid is 3 to 10 wt% of the coating liquid for the protective layer. The protective layer may also be coated simultaneously with the emulsion layer.

DETAILED DESCRIPTION OF THE PREFERRED EMBODIMENTS

Figure 1:
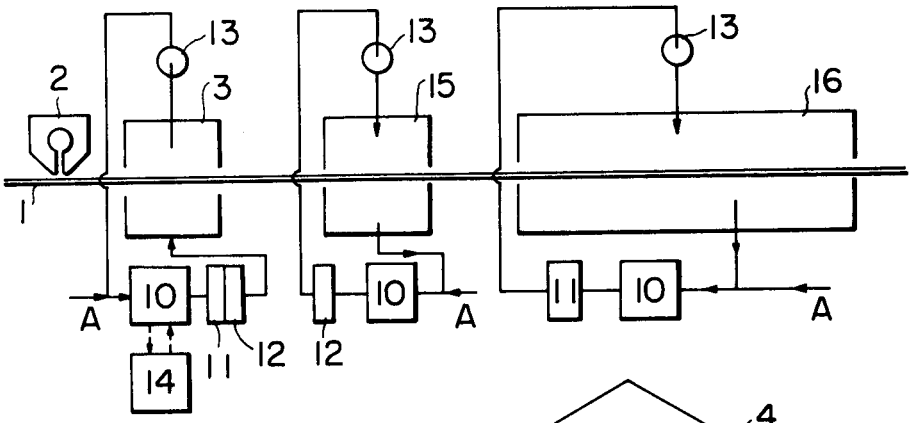
FIG. 1 shows a simplified flow diagram of an apparatus for making photographic light-sensitive material according to one embodiment of the present invention.

A continuously travelling web 1, after having a photographic emulsion applied by a coating device 2, is fed into a microwave concentrating device 3 comprising a microwave oscillator 4 and an undulating waveguide 5. The coated web passes through the waveguide via slits 7 while being supported on transport rollers 6, and is subjected to irradiation by microwave energy to concentrate the coating. Reference numeral 8 designates a dummy load for absorbing microwave energy not absorbed by the coating, and exhaust ports 9 are provided for discharging gases. The slits 7 should be of sufficient size enough to allow the web to pass therethrough without contacting the waveguide 5, while at the same time being small enough to minimize microwave leakage. To meet such conflicting requirements it is desirable to provide eaves (not shown) at the upper and lower portions of the slits 7 having surfaces parallel to the travelling direction of the web. The length of the eaves in such direction is normally 1 to 2 times of width of the slits. The actual size of the slit gaps depends not only on the presence of the eaves but also on the microwave frequencies used. Generally speaking, with eaves installed the gap size is 25 to 40 mm, preferably about 30 mm, for 915 MHz, and 10 to 20 mm, preferably about 15 mm, for 2450 MHz.

Air is supplied to the microwave concentrating device 3 in a direction of arrow A and is subjected to temperature and humidity adjustment by dehumidifiers 10, heaters 11 and coolers 12. The air is then blown onto the web and enters the waveguide 5, and is discharged outside the system by fans 13 through the exhaust ports 9. The discharged air is recycled to recover the solvent by means of a solvent recovering unit 14 and reused along with newly supplied air.

The web 1 with the coating concentrated in the manner described is fed into a cooling and solidifying device 15 where a low temperature air flow is applied to cool and solidify the coating. This low temperature air is also recycled.

The web with the cooled and solidified coating is then fed to a drier device 16 where the web is dried by air in a conventional manner, and thereafter it is fed to a humidity control zone (not shown). The air used in the drier 16 is recycled and reused.

The present invention provides the following advantages:

(1) The drying time may be considerably reduced.

(2) The drying zone can be made shorter if the coating speed is kept constant, and therefore the cost of the installation may be reduced.

(3) In an existing drying device an increase in production may be realized by increasing the coating speed without lengthening the drying zone.

(4) The drying of the web in the zone which most greatly affects the material quality is carefully carried out by air, and hence the overall drying time may be considerably reduced without greatly affecting quality.

(5) Organic solvents contained in the photographic emulsion may easily be recovered to reduce environmental protection costs.

(6) Since the interior of the coating is heated by microwave irradiation, a blocking film caused by drying the surface of the coating is not formed on the surface of the coating as in the case of wind drying.

(7) Since the coating is concentrated before being cooled and set, the time required for cooling and solidifying is reduced. It is also possible to omit the solidifying process depending upon the kind and composition of photographic emulsion used. Therefore, the cost of the solidifying installation and the overall operational cost can be reduced.

For a better understanding of the effects of the present invention, the following examples are given:

EXAMPLE 1

A photographic emulsion as a lower layer with components consisting of silver bromide (50 mg/100 $cm^2$) and gelatin (40 mg/100 $cm^2$), and an upper protective coating layer including gelatin (9 mg/100 $cm^2$), mat agent and surface active agent were coated in quantities of 90 cc/$m^2$ and 20 cc/$m^2$, respectively, in layer relation, on a polyethylene terephthalate film.

After coating a specimen A was passed through a cooling air zone at a dew point of −10° C. and a dry bulb temperature of 3 to 5° C. for fifteen seconds similar to the prior art to cool and solidify the film surface, after which it was dried in 6.3 minutes by air at a dry bulb temperature of 20° to 35° C. and a relative humidity of 30 to 65%, and humidity controlled by air at a dry bulb temperature of 25° C. and a relative humidity of 60% for one minute.

A specimen B was cooled and solidified under the same conditions as specimen A and then dried for five minutes using air at a dry bulb temperature of 25° to 38° C. and a relative humidity of 30 to 65%, after which it was humidity controlled under the same conditions as specimen A.

Figure 2:
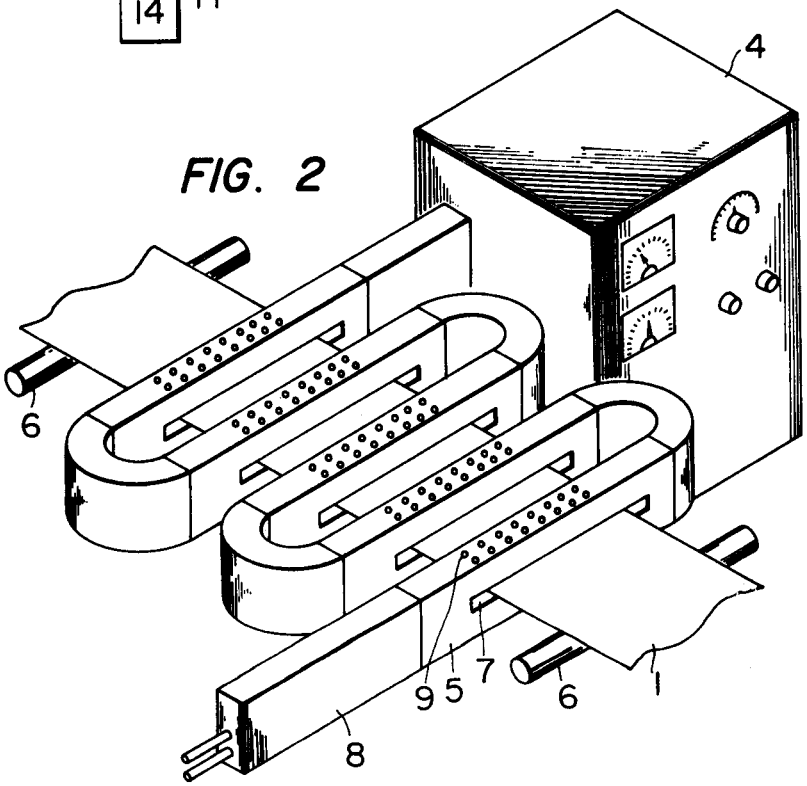
FIG. 2 shows a perspective view of one embodiment of a microwave irradiating and concentrating device.
Figure 3:
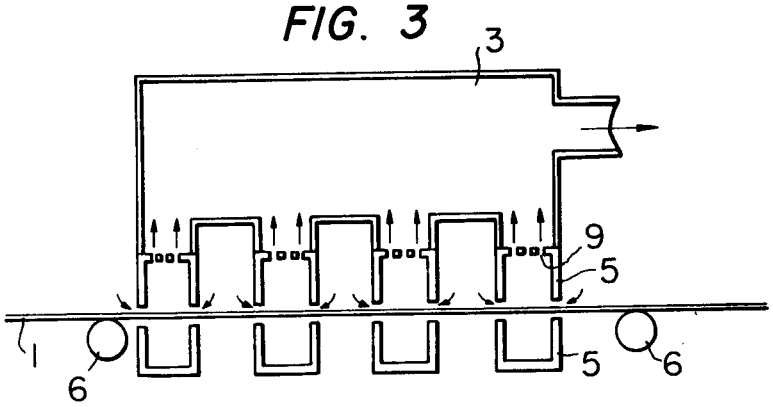
FIG. 3 shows a schematic sectional view of one embodiment of a microwave concentrating device in accordance with the present invention.

A specimen C was heated for 20 seconds employing the method according to the present invention as shown in FIGS. 1 to 3, using two microwave oscillators of 2,450 MHz and 5 kW to vaporize approximately one half of the water content, after which it was cooled for ten seconds at a dry bulb temperature of 5° to 8° C. to cool and solidify the film surface. The specimen was then dried for 4.6 minutes using air at a dry bulb temperature of 25° C. and a relative humidity of 40 to 65%, and further humidity controlled under the same conditions as specimen A.

The thus obtained specimens A, B and C were cut into two pieces 5 cm square, left in a relative humidity atmosphere of 90% for one minute, and thereafter placed one on the other under a load of 1 Kg and left in an atmosphere of 45° C. for two days. The respective specimens were then removed and the areas at which they adhered were measured to obtain the results given in Table 1 below.

TABLE 1

| | |
|---|---|
| Specimen A | 15% |
| Specimen B | 55% |
| Specimen C | 18% |

As seen from Table 1, specimens A and C were good. With respect to photographic properties, physical properties of coating layer and other performance criteria, there was no appreciable difference between the respective specimens. Specimen C according to the present invention thus exhitited equal performance despite the fact that its drying zone was on the order of 70% shorter, including the microwave heating zone, than in the case of specimen A.

EXAMPLE 2

A photographic emulsion as a lower layer consisting of silver bromide (90 mg/100 $cm^2$) and gelatin (40 mg/100 $cm^2$), and an upper protective coating layer including gelatin (18 mg/100 $cm^2$), mat agent and surface active agent were coated in quantities of 98 cc/$m^2$ and 18 cc/$m^2$, respectively, in layer relation, on a polyethylene terephthalate film 80 $\mu$ thick and 30 cm wide continuously travelling at 20 m/min.

The coatings were cooled, solidified and dried in a manner similar to Example 1 to obtain specimens D, E and F.

The thus obtained specimens were subjected to development and fixation treatment without being allowed to dry, and their degrees of haze were measured to obtain the results given in Table 2 below.

TABLE 2

| | |
|---|---|
| Specimen D | 35% |
| Specimen E | 52% |
| Specimen F | 34% |

As seen from Table 2, specimen F according to the present invention exhibited performance equal to that of the specimen D despite its higher drying speed. With respect to other performance criteria, there was practically no difference.

EXAMPLE 3

A positive collar photographic emulsion as a lower layer consisting of silver bromide (40 mg/100 $cm^2$), gelatin (21 mg/100 $cm^2$) and a coupler, and an upper protective coating layer including gelatin (10 mg/100 $cm^2$), mat agent and surface active agent were coated in quantities of 60 cc/$m^2$ and 20 cc/$m^2$, respectively, in layer relation, on a cellulose triacetate film 135 $\mu$ thick and 30 cm wide continuously travelling at 20 m/min.

After coating, a specimen G was cooled and solidified in an air cooling zone at a dry bulb temperature of 2° C. for 25 seconds and further air dried at a dry bulb temperature of 25 to 40 C. and a relative humidity of 30 to 50% for 4.8 minutes, after which it was himidity controlled at 25° C. and 60% R.H.

A specimen H was processed in accordance with the present invention. That is, the temperature of the coated surface was measured in a non-contact manner by an infrared meter and air at a dew point of −2° C. and a dry bulb temperature of 27° C. was fed over the surface for 2.0 minutes while the output power of the microwave oscillators was adjusted such that the temperature of the coated surface was maintained at 20° to 25° C. The specimen was then further dried at 25°-30° C. and 30-40% R.H., after which it was humidity controlled under the same conditions as specimen G.

After testing specimens G and H as to the photographic properties (such as fog and sensitivity) and physical properties (such as scratch strength and the amount of swelling) of their coating surfaces, no significant differences were found between them even though specimen H was dried at a speed approximately 40% higher than specimen G.

What is claimed is:

1. In a method of making photographic lightsensitive material wherein a photographic emulsion is coated on a continuously travelling web and thereafter subjected to a controlled drying process including a first drying period having a substantially constant drying rate followed by a second drying period having a decreasing drying rate, the improvement characterized by:

irradiating the surface of the photographic emulsion coating with microwave energy during said first, substantially constant rate drying period to concentrate the coating by evaporating therefrom a desired percentage of its water content before subjecting it to said second, decreasing rate drying period and without cooling and setting it, thereby reducing the time required for said second drying period.

2. A method as defined in claim 1, further comprising establishing a forced flow of gas over the coating during such microwave irradiation under controlled temperature and humidity conditions.

3. A method as defined in claim 2 wherein more than approximately 200 percent water content contained in the photographic emulsion coating is evaporated by said microwave irradiation.

* * * * *